US007138760B2

(12) United States Patent
Kim

(10) Patent No.: US 7,138,760 B2
(45) Date of Patent: Nov. 21, 2006

(54) ELECTRON EMISSION DEVICE AND ELECTRON EMISSION DISPLAY HAVING BEAM-FOCUSING STRUCTURE USING INSULATING LAYER

(75) Inventor: Si Myeong Kim, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/137,135

(22) Filed: May 24, 2005

(65) Prior Publication Data

US 2006/0006790 A1 Jan. 12, 2006

(30) Foreign Application Priority Data

May 25, 2004 (KR) ..... 10-2004-0037549

(51) Int. Cl.
*H01J 1/304* (2006.01)
*H01J 29/50* (2006.01)

(52) U.S. Cl. ..... 313/497; 313/309

(58) Field of Classification Search ..... 313/495, 313/496, 497, 309, 310, 311, 336, 351; 445/24, 445/25, 50, 51

See application file for complete search history.

(56) References Cited

U.S. PATENT DOCUMENTS

2005/0258739 A1* 11/2005 Park et al. ..... 313/497
2005/0264170 A1* 12/2005 Oh ..... 313/497

FOREIGN PATENT DOCUMENTS

| | | |
|---|---|---|
| JP | 2001-126609 | 5/2001 |
| JP | 2003-303538 | 10/2003 |
| KR | 2002-32208 | 5/2002 |
| KR | 2002-0051592 | 6/2002 |

OTHER PUBLICATIONS

Patent Abstract of Japan, Publication No. 2001-126609, Published on May 11, 2001, in the name of Ito, et al.
Patent Abstract of Japan, Publication No. 2003-303538, Published on Oct. 24, 2003, in the name of Niyama, et al.
Korean Patent Abstract, Publication No. 1020020051592 A, Published on Jun. 29, 2002, in the name of Cho, et al.

* cited by examiner

*Primary Examiner*—Mariceli Santiago
*Assistant Examiner*—Anne M Hines
(74) *Attorney, Agent, or Firm*—Christie, Parker & Hale LLP

(57) ABSTRACT

An electron emission device and/or display using the same includes a beam-focusing structure. The beam-focusing structure has a first insulating layer formed on a plate. The first insulating layer has a thickness, and is formed with a first hole. A first electrode is formed on the first insulating layer and extending into the first hole. An emission portion is formed in the first hole and connected to the first electrode. A second insulating layer is formed on the first electrode and is also formed with a second hole through which the emission portion is at least partially exposed. A second electrode is formed on the second insulating layer. In the electron emission device and/or the display, an electric field between the first electrode and the second electrode causes the emission portion to emit an electron beam and focuses the electron beam from the emission portion.

21 Claims, 4 Drawing Sheets

ELECTRON EMISSION DEVICE AND ELECTRON EMISSION DISPLAY HAVING BEAM-FOCUSING STRUCTURE USING INSULATING LAYER

CROSS-REFERENCE TO RELATED APPLICATIONS

This application claims priority to and the benefit of Korean Patent Application No. 10-2004-0037549, filed May 25, 2004 in the Korean Intellectual Property Office, the entire content of which is incorporated herein by reference.

BACKGROUND

1. Field of the Invention

The present invention relates to an electron emission device, and more particularly, to an electron emission device and an electron emission display having a beam-focusing structure using an insulating layer.

2. Discussion of Related Art

Generally, an electron emission device can be classified into a hot cathode-type and a cold cathode-type. The hot cathode-type and the cold cathode-type employ a hot cathode and a cold cathode as an electron emission portion, respectively.

Also, a cold cathode-type electron emission device can have a structure such as a field emitter array (FEA), a surface conduction emitter (SCE), a metal insulator metal (MIM), a metal insulator semiconductor (MIS), a ballistic electron surface emitting (BSE), etc.

The electron emission device having the FEA structure is based on a principle that when a material having a low work function and/or a high beta(β)-function is used as an electron emission portion in a vacuum, electrons are easily emitted from the material due to an electric field difference. Such electron emission device having the FEA structure employs a tip structure mainly containing molybdenum (Mo), silicon (Si), a carbon material (e.g., graphite, diamond-like carbon (DLC), etc.), and/or a nano material (e.g., a nanotube, a nanowire, etc.) as the electron emission portion.

The electron emission device having the SCE structure is provided with an electron emission part in which a first electrode and a second electrode opposing each other are formed on a first plate, and a conductive layer is formed between the first electrode and the second electrode. The conductive layer is formed with a minute crack or gap, thereby forming the electron emission part. Such electron emission device is based on a principle that the electron emission part formed by the minute crack or gap emits electrons when electric current flows through a surface of the conductive layer by applying voltage to the first and second electrodes.

The electron emission device having the MIM or MIS structure includes an electron emission portion having a metal-insulator-metal structure or a metal-insulator-semiconductor structure, and is based on a principle that electrons are emitted from the metal or the semiconductor of high-electric potential to the metal of low-electric potential when a voltage is applied between the metal and the metal or between the metal and the semiconductor.

The electron emission device having the BSE structure is based on a principle that electrons travel without sputtering when the size of a semiconductor is smaller than a mean free path of the electrons contained in the semiconductor. Such electron emission device includes an electron supplying layer made of a metal or a semiconductor and formed on an ohmic electrode, an insulator formed on the electron supplying layer, and a thin metal layer formed on the insulator, so that the electrons are emitted when a voltage is applied between the ohmic electrode and the thin metal layer.

The foregoing electron emission devices are employed in electron emission displays, backlights, lithography electron beams, etc.

In the aforementioned electron emission devices, the electron beam emitted from the electron emission portion spreads in a voltage-applied direction. Therefore, there is a need for a focusing electrode to focus the electron beam. An example of an electron emission device with the focusing electrode is disclosed in Korean Patent Publication No. 2002-32208. Hereinafter, the conventional electron emission device with the focusing electrode will be described with reference to FIGS. 1 and 2.

FIG. 1 is a schematic plan view of a conventional electron emission device with a horizontal focusing electrode.

As shown therein, the conventional electron emission device includes a plurality of micro-tips 1 respectively formed inside a plurality of gate holes 2, a gate electrode 3 formed above the micro-tips 1 and determining an emitting direction of electrons emitted from each micro-tip 1, and a focusing electrode 4 to focus the electrons emitted from the micro-tips 1.

In the conventional electron emission device, to enhance a focusing effect, a distance between at least one of the micro-tips 1 used as an emitter and the gate electrode 3 should be short, and, at the same time, a distance between the gate electrode 3 and the focusing electrode 4 should also be short. Because of this, the fabricating process for the conventional electron emission device is difficult. Also, when the focusing electrode 4 is horizontally arranged, the number of emitters per unit surface area is limited.

FIG. 2 is a sectional view of a conventional electron emission device with a vertical focusing electrode.

As shown in FIG. 2, the conventional electron emission device includes a plate 202, a first insulator 203, a gate electrode 204, an emitter 205, a cold cathode 206, a second insulator 207, a focusing electrode 208 and a metal mesh 210. In this electron emission device, in order to focus an electron beam from the emitter 205, a voltage of −40V is applied to the focusing electrode 208 and a voltage of 80V is applied to the gate electrode 204. Here, the voltage applied to the gate electrode 204 serves to control the amount of beam current.

Such conventional electron emission device with the vertical focusing electrode is excellent in focusing the electron beam, but has a complicated fabricating process because the insulator formed on the gate electrode should be thick with a thickness of a few μm to a few hundreds μm, thereby lowering a yield thereof.

SUMMARY OF THE INVENTION

Accordingly, it is an aspect of the present invention to provide an electron emission device and an electron emission display having a beam-focusing structure using an insulating layer, which is not only excellent in focusing an electron beam but also has a simple fabricating process.

Another aspect of the present invention is to provide an electron emission device and an electron emission display using the same in which the electron emission device is fabricated by a simple, low-cost process, and is improved in focusing efficiency.

In one embodiment of the present invention, an electron emission device includes: a first insulating layer formed on a plate, having a predetermined thickness, and formed with a first hole; a first electrode formed on the first insulating layer and extending into the first hole; an electron emission portion located in the first hole and connected to the first electrode; a second insulating layer formed on the first electrode and formed with a second hole through which the electron emission portion is at least partially exposed; and a second electrode formed on the second insulating layer, wherein an electric field between the first electrode and the second electrode causes the electron emission portion to emit an electron beam and focuses the electron beam from the electron emission portion.

In one embodiment of the present invention, an electron emission display includes: first and second plates opposing each other, and having a space therebetween; a first insulating layer formed on the first plate, having a predetermined thickness, and formed with a first hole; a cathode electrode formed on the first insulating layer and extended into the first hole; an electron emission portion located in the first hole and connected to the cathode electrode; a second insulating layer formed on the cathode electrode and formed with a second hole through which the electron emission portion is at least partially exposed; a gate electrode formed on the second insulating layer; and a display part formed on the second plate and displaying a picture based on electrons emitted from the electron emission structure, wherein an electric field between the cathode electrode and the gate electrode causes the electron emission portion to emit an electron beam and focuses the electron beam from the electron emission portion.

According to an embodiment of the invention, the thickness of the first insulating layer ranges from about four to six times larger than the thickness of the electron emission portion. Here, the thickness of the first insulating layer can be increased in proportion to a distance between the electron emission portion and an inner wall of the first hole.

According to an embodiment of the invention, the first electrode (or the cathode electrode) is formed on the inner wall of the first hole and surrounds the electron emission portion.

According to an embodiment of the invention, the first insulating layer and the second insulating layer differ in their etching rates. Thus, the inner wall of the first hole is formed substantially perpendicular onto the plate, and an inner wall of the second hole slopes with respect to the plate.

According to an embodiment of the invention, the electron emission portion includes a nanotube material, a carbon nanotube (CNT) material, a nanowire material, a fullerene ($C_{60}$) material, a diamond-like carbon (DLC) material, and/or a graphite material.

According to an embodiment of the invention, the cathode includes an indium tin oxide (ITO) material.

According to an embodiment of the invention, the display part includes a fluorescent layer formed on the second plate, and a thin metal film formed on the fluorescent layer. Alternatively, the display part includes a transparent electrode formed on the second plate, and a fluorescent layer formed on the transparent electrode. Further, the display part additionally includes a thin metal film formed on the fluorescent layer. Additionally, the display part additionally includes a dark region formed between the fluorescent layers.

According to an embodiment of the present invention, the electron emission display further includes a grid electrode provided between the first plate and the second plate and formed with a plurality of holes through which the electrons pass.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, exemplary embodiments of the present invention are shown and described by way of illustration. Accordingly, the drawings and description are to be regarded as illustrative in nature, and not restrictive.

Figure 1:
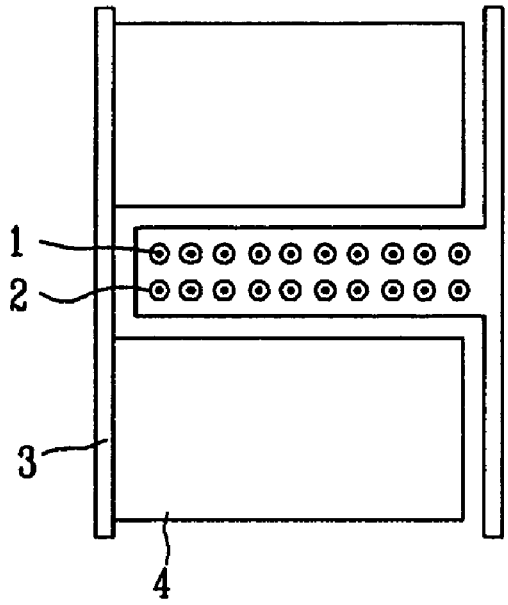
FIG.1 (PRIOR ART)
FIG. 1 is a plan view of a conventional electron emission device with a horizontal focusing electrode.
Figure 2:
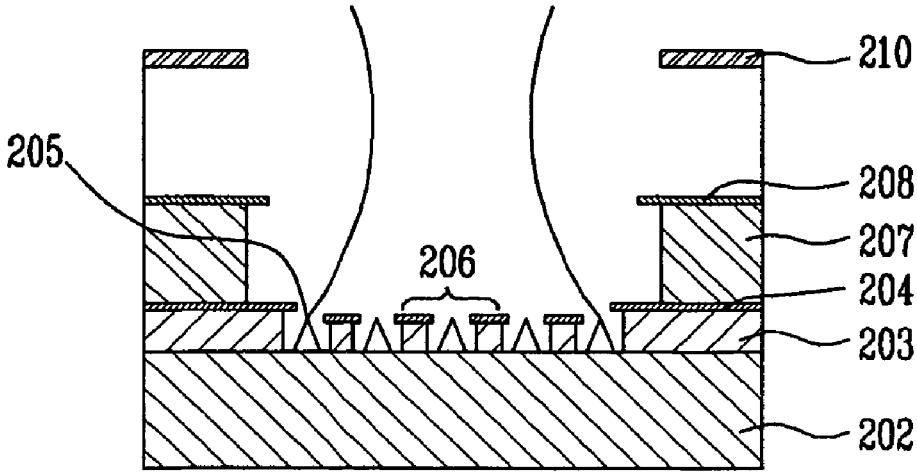
FIG.2 (PRIOR ART)
FIG. 2 is a sectional view of a conventional electron emission device with a vertical focusing electrode.
Figure 3:
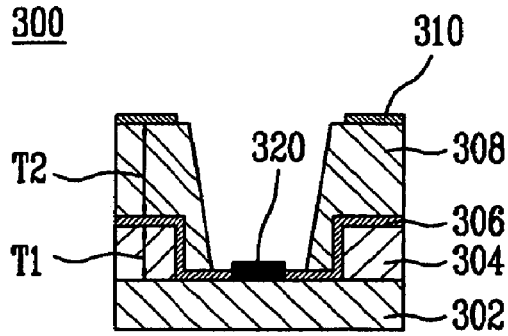
FIG. 3 is a sectional view of an electron emission device having a beam-focusing structure according to an embodiment of the present invention.

FIG. 3 is a sectional view of an electron emission device having a beam-focusing structure according to an embodiment of the present invention.

Referring to FIG. 3, an electron emission device 300 includes a plate 302, a first insulating layer 304, a cathode electrode 306, a second insulating layer 308, a gate electrode 310, and an electron emission portion 320. The plate 302 may be formed of a transparent plate such as a vitreous plate.

The first insulating layer 304 is made of insulating material having a first etching rate and formed on the plate 302. The first insulating layer 304 is formed with a first hole through which the plate 302 or a buffer layer (not shown) on the plate 302, to be formed with the electron emission portion 320, are exposed. An inner wall of the first hole is substantially perpendicular to a surface of the plate 302. The thickness T1 of the first insulating layer 304 is approximately four to six times larger than the thickness of the electron emission portion 320. For example, in the case where the electron emission portion 320 has a thickness of about 2 μm, the first insulating layer 304 should have a thickness of about 10 μm.

The cathode electrode 306 may be made of transparent conductive material such as indium tin oxide (ITO) and formed on the first insulating layer 304. The cathode electrode 306 extends to an inside of the first hole. In the first hole, the cathode electrode 306 is connected to the electron emission portion 320. At this time, the cathode electrode 306 is connected to the electron emission portion 320, covering the whole bottom area of the first hole or covering the inner wall and a portion of the bottom area of the first hole.

The second insulating layer 308 is made of insulating material having a second etching rate and is formed on the cathode electrode 306. The second insulating layer 308 is formed with a second hole through which the cathode electrode 306, at an area to be formed with the electron emission portion 320, is exposed. An inner wall of the second hole slopes to cover a portion of the cathode electrode 306 formed on the inner wall of the first hole. The thickness T2 of the second insulating layer 308 is appropriately selected in consideration of a breakdown voltage between the cathode electrode 306 and the gate electrode 310. Further, the thickness of the second insulating layer 308 is appropriately selected in consideration of the thickness of the electron emission portion 320 and a space between the gate electrode 310 and the electron emission portion 320. For example, in the case where the cathode electrode 306 is applied with a voltage of −80V and the gate electrode 310 is applied with a voltage of 70V, the second insulating layer 308 should have a thickness of about 15 μm. However, the thickness of the second insulating layer may vary according to the type and the characteristics of the insulating material.

The gate electrode 310 is formed on the second insulating layer 308 in a predetermined pattern. The gate electrode 310 is disposed for easily inducing the electron emission portion 320 to emit electrons.

The electron emission portion 320 is formed in the first hole and the second hole superposed on the first hole and is connected to the cathode electrode 306. For example, the electron emission portion 320 is directly formed on the plate 302 and connected with the cathode electrode 306 on at least one side. In FIG. 3, the portion of the cathode electrode 306 surrounding the electron emission portion 320 in the first hole is relatively high, thereby enhancing a beam-focusing effect. Alternatively, the electron emission portion 320 can be formed on the cathode electrode 306. The electron emission portion 320 can be made of nanotube (e.g., carbon nanotube (CNT)), nanowire, fullerene ($C_{60}$), diamond-like carbon (DLC), and/or graphite materials.

As described above, the electron emission device of FIG. 3 according to an embodiment of the present invention includes the first insulating layer 304, formed to have a predetermined pattern on the plate 302, and the cathode electrode 306 formed on the first insulating layer 304. The cathode electrode 306 forms a beam-focusing structure using the first insulating layer 304. Here, the beam-focusing structure indicates that the cathode electrode 306 surrounds the electron emission portion 320 in the first hole of the first insulating layer 304 at a predetermined height. Such a beam-focusing structure allows the electron beam emitted from the electron emission portion 320 to react against a voltage, e.g., negative voltage applied to the cathode electrode 306 and to be focused into the center of the second hole (e.g., as in FIG. 5). Hence, the electron emission device according to an embodiment of the present invention has a simple structure but is excellent in focusing the electron beam.

Figure 4:
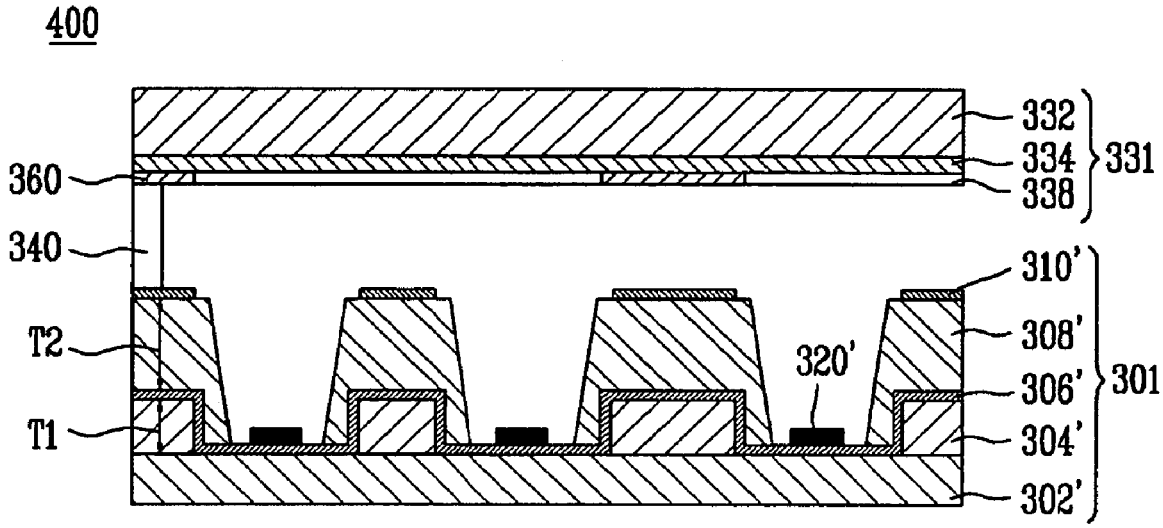
FIG. 4 is a partially sectional view of an electron emission display using the electron emission device having the beam-focusing structure according to an embodiment of the present invention.
Figure 5:
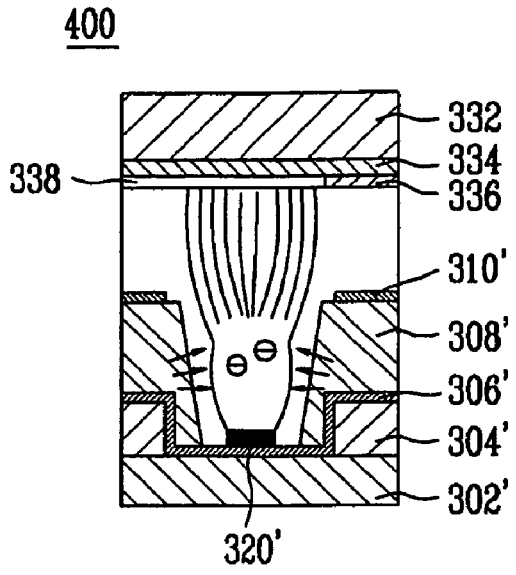
FIG. 5 illustrates a beam-focusing effect of the electron emission display of FIG. 4.

FIG. 4 is a partially sectional view of an electron emission display using the electron emission device having the beam-focusing structure according to an embodiment of the present invention, and FIG. 5 illustrates a beam-focusing effect of the electron emission display of FIG. 4.

Referring to FIG. 4, an electron emission display 400 includes an electron emission structure 301, a display part 331, and a spacer 340. The spacer 340 is disposed between the electron emission structure 301 and the display part 331, so that the electron emission structure 301 and the display part 331 are opposing each other with a space between them.

The electron emission structure 301 includes a first plate 302', a first insulating layer 304', a cathode electrode 306', a second insulating layer 308', a gate electrode 310', and an electron emission portion 320'. The electron emission structure 301 is similar to a structure having a plurality of aforementioned electron emission devices 300 of FIG. 3. However, in FIGS. 4 and 5, the electron emission portion 320' is formed on the cathode electrode 306' (rather than directly formed on the plate 302 of FIG. 3). Therefore, descriptions of the electron emission structure 301 will be abbreviated to avoid repetitive descriptions.

The display part 331 may have various shapes, and hereinafter, one example thereof will be described. On the other hand, other examples thereof will be described with reference to FIGS. 7A and 7B.

The display part 331 includes a second plate 332, an anode electrode 334, and a fluorescent layer 338. Additionally, the image realizer 331 may include a dark region 336. The second plate 332 is formed of a transparent plate such as a vitreous plate.

The anode electrode 334 is formed on the second plate 332, covering the whole area of the second plate 332, or having a predetermined division shape (or pattern) such as a striped shape (or pattern) or the like. The anode electrode 334 can be made of a conductive transparent material such as ITO, or by making metal, such as chromium (Cr), aluminum (Al), molybdenum (Mo), copper (Cu), etc., thin and transparent.

The fluorescent layer 338 is formed on the anode electrode 334 with a striped shape (or in a striped pattern) or with a dotted shape (or in a dotted pattern). The fluorescent layer 338 includes a high-voltage fluorescent material or a low-voltage fluorescent material according to voltages applied to the anode electrode 334. The florescent layer 338 should be made of a fluorescent material having excellent efficiency, life-span, and/or color purity.

The display part 331 further includes a dark region 336. The dark region 336 is made of a conductive material having a dark color and formed to have a matrix shape (or pattern) or a striped shape (or pattern) on the anode electrode 334. The dark region 336 forms a non-luminous region between luminous regions due to the fluorescent layer 338. The dark region 336 can be abbreviated according to the type, structure and shape of the electron emission display 400.

In addition, the electron emission display 400 should be sealed in a vacuum so as to increase a mean free path of the electrons; prevent a work function from changing due to gas particles absorbed into the electron emission portion; protect the electron emission portion from physical and chemical damage due to ionized gas particles; prevent a track of the electron beam from changing; and/or protect the fluorescent layer from damage due to vapor, oxygen, carbon monoxide, carbon dioxide, methane, etc.

Thus, as shown in FIG. 5, the electron emission display 400 according to an embodiment of the present invention includes the cathode electrode 306' of the beam-focusing structure using the first insulating layer 304', so that the electron beam emitted from the electron emission portion 320' is focused into the center of the hole by the voltage, e.g., negative voltage applied to the cathode electrode 306', thereby enhancing the beam-focusing effect.

Further, the electron emission display 400 according to an embodiment of the present invention can be, as shown in FIG. 4, fabricated by adding only a process of forming the first insulating layer 304' at a predetermined height on the plate 302' under the-cathode electrode 306'. Thus, the fabricating process of the electron emission display 400 according to an embodiment of the present invention is simple as compared with the conventional display having the beam-focusing structure (e.g., the structure having a separate or dedicated focusing electrode).

Hereinafter, an electron emission display according to another embodiment of the present invention will be described with reference to FIG. 6.

Figure 6:
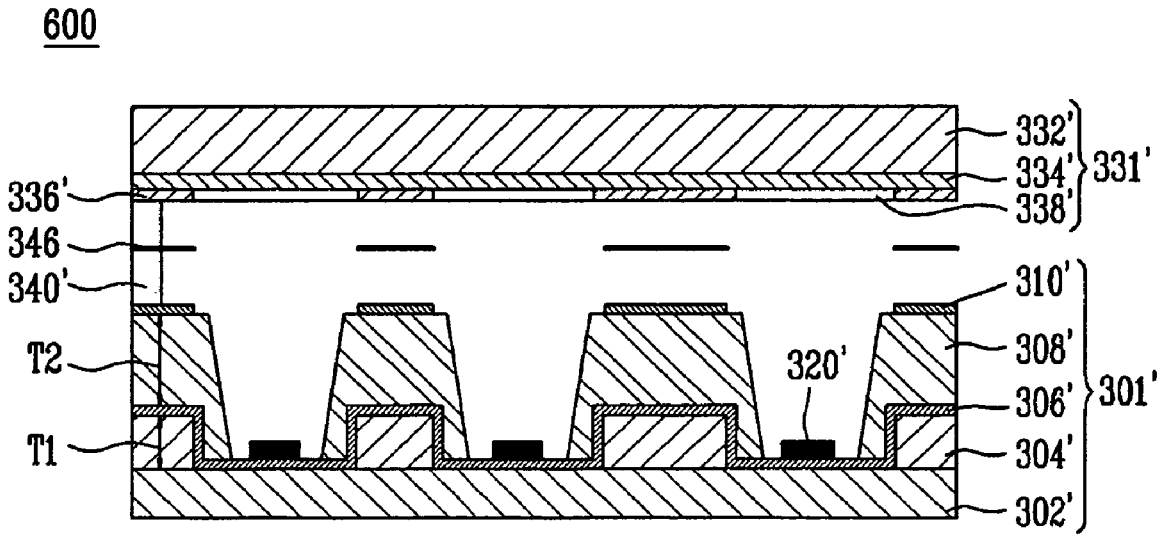
FIG. 6 is a sectional view of an electron emission display according to another embodiment of the present invention.
Figure 7A:
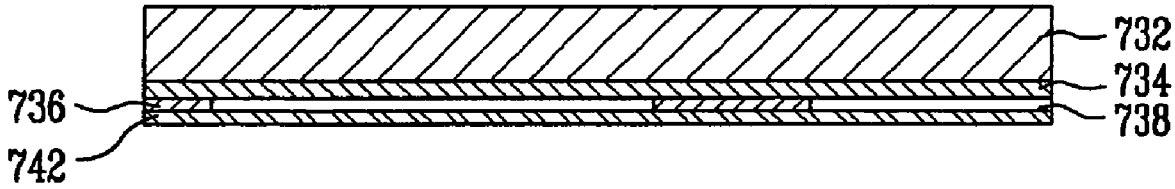
FIGS. 7A and 7B are sectional views of a display part applicable to the electron emission display according to an embodiment of the present invention.
Figure 7B:
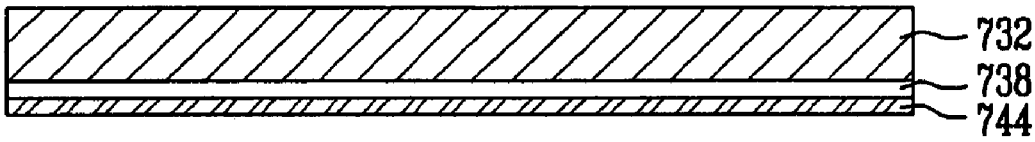

FIG. 6 is a sectional view of another electron emission display including an electron emission device having a grid electrode according to the another embodiment of the present invention, and FIGS. 7A and 7B are sectional views of a display part applicable to the electron emission display according to an embodiment of the present invention.

Referring to FIG. 6, an electron emission display 600 includes an electron emission structure 301, a display part 331', a spacer 340', and a grid electrode 346. The spacer 340' is disposed between the electron emission structure 301 and the display part 331', so that the electron emission structure 301 and the display part 331' are opposing each other with a space between them.

The electron emission structure 301 includes a first plate 302', a first insulating layer 304', a cathode electrode 306', a second insulating layer 308', a gate electrode 310', and an electron emission portion 320'. Such an electron emission structure 301 is similar to a structure having a plurality of aforementioned electron emission devices 300. However, in FIG. 6, the electron emission portion 320' is formed on the cathode electrode 306' (rather than directly formed on the plate 302 of FIG. 3). Therefore, descriptions of the electron emission structure 301 will be abbreviated to avoid repetitive descriptions.

The display part 331' includes a second plate 332', an anode electrode 334', a dark region 336' and a fluorescent layer 338'. Such a display part 331' is similar to the above-mentioned display part 331 of FIGS. 4 and 5. Therefore, descriptions of the display part 331' will be abbreviated to avoid repetitive descriptions.

The grid electrode 346 is appropriately provided above the gate electrode 310' or attached to the spacer 340'. The grid electrode 346 includes a plurality of through-holes or a plurality of windows through which the electrons emitted from the electron emission portion 320' pass. The grid electrode 346 prevents the electron beam from colliding, not with the target fluorescent layer 338', but with the non-target fluorescent layer, thereby preventing the fluorescent layer 338' from representing unwanted colors. Further, the grid electrode 346 can be employed as a focusing electrode to focus the electron beam emitted from the electron emission portion 320'. Such grid electrode 346 can include a sheet-type metal mesh.

Thus, the electron emission display 600 according to an embodiment of the present invention includes the grid electrode 346, so that the electron emitted from the electron emission portion 320' is primarily focused by the beam-focusing structure of the cathode electrode 306' and then secondarily focused by the grid electrode 346. Thus, the electron emission display 600 including both the cathode and grid electrodes 306', 346 has a good beam-focusing effect as compared with the conventional electron emission display basically having just the grid electrode.

In the foregoing embodiments, the electron emission display 300, 400, 600 includes a display part that displays a picture based on the electron emitted from the electron emission structure 301 and colliding with the fluorescent layer 338, 338'. Such display part is not limited to the foregoing description and may vary.

For example, as shown in FIG. 7A, the display part includes a second plate 732, an anode electrode 734 formed on the second plate 732, a fluorescent layer 738 formed on the anode electrode 734, and a thin metal film 742 formed on the fluorescent layer 738. Further, a dark region 736 shown in FIG. 7A may be selectively formed on the anode electrode 734. The anode electrode 734 can be in the form of a transparent plate. Here, the thin metal film 742 protects the electron emission structure 301 from damage due to an electric arc generated from the fluorescent layer 738 and can be also functioned as an anode electrode (e.g., a second anode electrode or an anode electrode that replaces the anode electrode 734).

For example, as shown in FIG. 7B, the display part includes a second plate 732', a fluorescent layer 738' formed on the second plate 732', and a thin metal electrode 744 formed on the fluorescent layer 738'. Here, the thin metal electrode 744 functions as the anode electrode. Such display part is adapted to a high-voltage electron emission display using thousands of volts or more.

As described above, the present invention provides an electron emission device and an electron emission display using the same, which forms a beam-focusing structure using an insulating layer, thereby making the electron emission device and the electron emission display using the same more easily fabricated and being excellent in focusing an electron beam.

Further, the present invention provides an electron emission display having an improved beam-focusing structure, thereby enhancing color representation or reproduction.

Although a few embodiments of the present invention have been shown and described, it would be appreciated by those skilled in the art that changes may be made in these embodiments without departing from the principles and spirit of the invention, the scope of which is further defined in the appended claims and their equivalents.

What is claimed is:

1. An electron emission device comprising:

a first insulating layer of a predetermined thickness formed on a plate, the first insulating layer having a first hole;

a first electrode formed on the first insulating layer and extending into the first hole;

an electron emission portion located in the first hole and connected to the first electrode;

a second insulating layer formed on the first electrode and having a second hole through which at least a portion of the electron emission portion is exposed; and a second electrode formed on the second insulating layer, wherein an electric field between the first electrode and the second electrode causes the electron emission portion to emit an electron beam.

2. The electron emission device according to claim 1, wherein a thickness of the first insulating layer ranges from about four to six times larger than a thickness of the electron emission portion.

3. The electron emission device according to claim 2, wherein the first electrode is formed on an inner wall of the first hole and surrounds the electron emission portion.

4. The electron emission device according to claim 1, wherein the first insulating layer is etched with a first rate and the second insulating layer is etched with a second rate, and wherein the first rate differs from the second rate.

5. The electron emission device according to claim 4, wherein an inner wall of the first hole is substantially perpendicular to the plate, and an inner wall of the second hole slopes with respect to the plate.

6. The electron emission device according to claim 1, wherein the electron emission portion comprises a nanotube material, a carbon nanotube material, a nanowire material, a fullerene material, a diamond-like carbon material, and/or a graphite material.

7. The electron emission device according to claim 1, wherein the first electrode includes an indium tin oxide material.

8. An electron emission display comprising:

first and second plates opposing each other, and having a space therebetween;

a first insulating layer of a predetermined thickness formed on the first plate, the first insulating layer having a first hole;

a cathode electrode formed on the first insulating layer and extending into the first hole;

an electron emission portion located in the first hole and connected to the cathode electrode;

a second insulating layer formed on the cathode electrode and formed with a second hole through which the electron emission portion is at least partially exposed;

a gate electrode formed on the second insulating layer; and a display part formed on the second plate and displaying a picture based on electrons emitted from the electron emission structure, wherein an electric field between the cathode electrode and the gate electrode causes the electron emission portion to emit an electron beam.

9. The electron emission display according to claim 8, wherein a thickness of the first insulating layer ranges from about four to six times larger than a thickness of the electron emission portion.

10. The electron emission display according to claim 9, wherein the cathode electrode is formed on an inner wall of the first hole and surrounds the electron emission portion.

11. The electron emission display according to claim 8, wherein the first insulating layer is etched with a first rate and the second insulating layer is etched with a second rate, and wherein the first rate differs from the second rate.

12. The electron emission display according to claim 11, wherein an inner wall of the first hole is substantially perpendicular to the first plate, and an inner wall of the second hole slopes with respect to the first plate.

13. The electron emission display according to claim 8, wherein the electron emission portion comprises a nanotube material, a carbon nanotube material, a nanowire material, a fullerene material, a diamond-like carbon material, and/or a graphite material.

14. The electron emission display according to claim 8, wherein the cathode includes an indium tin oxide material.

15. The electron emission display according to claim 8, wherein the display part comprises a fluorescent layer formed on the second plate, and a thin metal film formed on the fluorescent layer.

16. The electron emission display according to claim 8, wherein the display part comprises a transparent electrode formed on the second plate, and a fluorescent layer formed on the transparent electrode.

17. The electron emission display according to claim 16, wherein the display part comprises a thin metal film formed on the fluorescent layer.

18. The electron emission display according to claim 16, wherein the display part comprises a dark region formed between the fluorescent layers.

19. The electron emission display according to claim 8, further comprising a grid electrode provided between the first plate and the second plate and formed with a plurality of holes through which the electrons pass.

20. The electron emission display according to claim 19, wherein the grid electrode comprises a sheet-type metal mesh.

21. An electron emission device comprising:

a first insulating layer of a predetermined thickness formed on a plate, the first insulating layer having a hole;

a cathode electrode formed on the first insulating layer and extending to an inside wall of the hole;

an electron emission portion located in the hole and connected to the cathode electrode;

a second insulating layer formed on the cathode electrode; and a second electrode formed on the second insulating layer, where in an electric field between the cathode electrode and the second electrode causes the electron emission portion to emit an electron beam and focuses the electron beam from the electron emission portion.

* * * * *